United States Patent [19]

Oehr

[11] 4,312,721

[45] Jan. 26, 1982

[54] ELECTROLYTIC OXIDATION PROCESS

[75] Inventor: Klaus H. Oehr, Surrey, Canada

[73] Assignee: B.C. Research Council, Vancouver, Canada

[21] Appl. No.: 149,904

[22] Filed: May 15, 1980

[51] Int. Cl.[3] ..... C25B 3/02

[52] U.S. Cl. ..... 204/78; 204/79; 204/80

[58] Field of Search ..... 204/78, 79, 80

[56] References Cited

U.S. PATENT DOCUMENTS 3,486,992 12/1969 Frye ..... 204/78

*Primary Examiner*—Howard S. Williams

*Attorney, Agent, or Firm*—Smyth, Pavitt, Siegemund & Martella

[57] ABSTRACT

An electrolytic process for converting cerous ion to ceric iron in an electrolytic cell including a cathode, an anode and an electrolyte. Cobalt is incorporated into the electrolyte in addition to the cerous ion.

11 Claims, 1 Drawing Figure

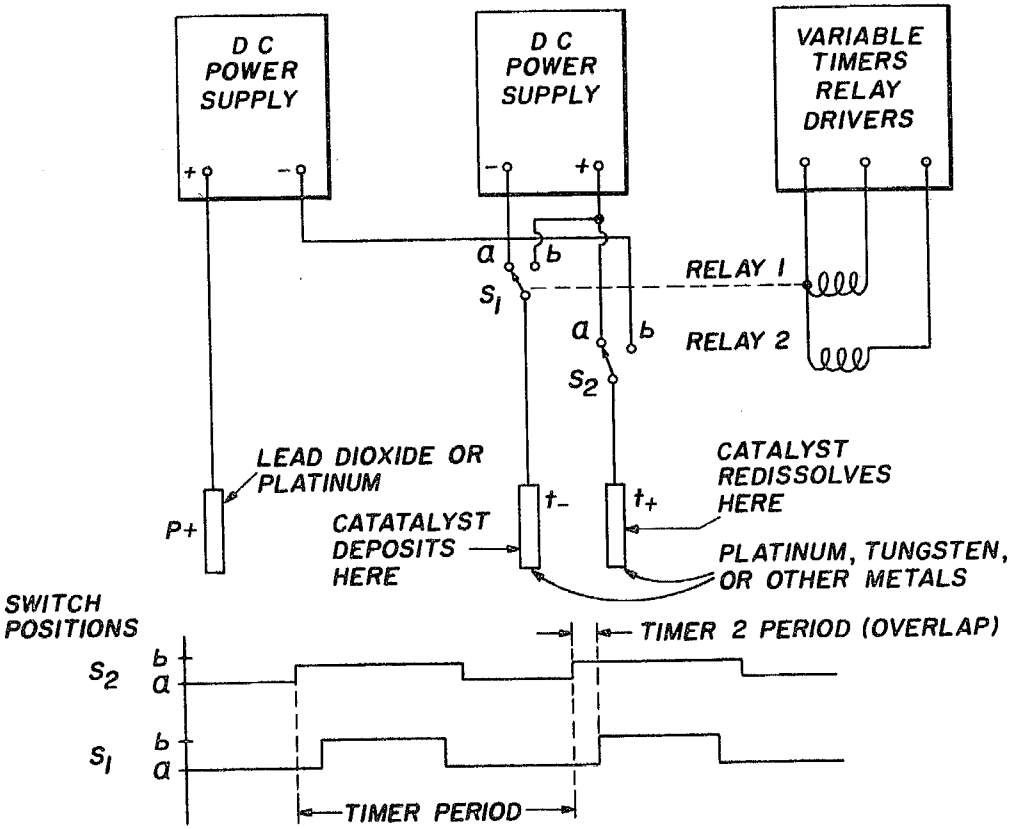
VARIABLE TIMERS RELAY DRIVERS
RELAY 1
RELAY 2
D C POWER SUPPLY
D C POWER SUPPLY
S1
S2
a
b
t+
t-
P+
CATALYST REDISSOLVES HERE
PLATINUM, TUNGSTEN, OR OTHER METALS
CATATALYST DEPOSITS HERE
LEAD DIOXIDE OR PLATINUM
TIMER 2 PERIOD (OVERLAP)
TIMER PERIOD
SWITCH POSITIONS

ELECTROLYTIC OXIDATION PROCESS

FIELD OF THE INVENTION

This invention relates to an electrolytic process for converting cerous ion to ceric ion.

DESCRIPTION OF THE PRIOR ART

The use of cerium and the ceric ion as oxidizing agents is well established in organic chemistry. For example Canadian Pat. No. 899,856 to Imperial Chemical Industries, issued May 9, 1972, describes, inter alia, the oxidation of a phenol to a diphenoquinone in the presence of a ceric compound. British Pat. No. 1,192,037 to Imperial Chemical Industries, Published Oct. 23, 1967, describes and claims the preparatin of quinones by oxidation of an aromatic hydrocarbon by contacting the hydrogen with an aqueous solution of a ceric compound. British Pat. No. 1,360,904 to ICI, published on July 24, 1974 describes a catalytic effect of cerium, in the form of the metal or a salt, in a liquid phase oxidation of an aromatic organic compound.

The regeneration of the ceric ion, after the oxidation, is also known. The ceric ion is, of course, reduced to the cerous ion during the oxidation of the organic compound. A variety of anodes, for example of lead dioxide or of platinum, can be used to electrooxidize the cerous ion to produce the ceric ion. The process is carried out in solution or suspension. For example ceric sulphate, ceric ammonium sulphate, ceric nitrate and ceric ammonium nitrate can be electrochemically generated from cerous sulphate, cerous ammonium sulphate, cerous nitrate and cerous ammonium nitrate respectively. The generation is normally carried out in an acidic electrolyte containing nitric, sulphuric or perchloric acid as the oxidizing power and stability of the ceric ion is higher in acidic solution.

There are a number of disadvantages to the existing processes for oxidizing the cerous ion to the ceric ion. For example cerous salts are only sparingly soluble in acid solutions, especially in dilute sulphuric acid. Cerous salts are considerably more soluble in dilute nitric acid but ceric oxidants contained in sulphuric acid are generally more useful than those in nitric acid. For example higher yields of naphthaquinone are produced from naphthalene by ceric ion oxidation in a dilute sulphuric acid medium. This is because nitric acid can react with the naphthalene or with the naphthaquinone to produce unwanted by-products. This production of unwanted by-products is discussed in the above British Pat. No. 1,192,037 and Canadian Pat. No. 899,856.

A further disadvantage in the regeneration of the ceric ion from the cerous ion is that the electro-chemical cells previously used have been restricted by the maximum solubility of the cerous-containing salt in the appropriate acid. The maximum current density that can be applied to a variety of suitable anodes is restricted by the number of cerus ions which can move to the electrode surface in a given time. This mass transfer of cerous ions is controlled by the speed with which the ions move due to temperature, electrolyte viscosity, density, electrolyte turbulence due to mixing, stirring or pumping and cerous ion concentration in the electrolyte.

Ramaswamy et al in Bull. Chem. Soc. Japan 35: 1751-5 (1962) recognized the problem of poor cerous ion transfer due to low solubility in sulphuric acid electrolytes but were unable to overcome the problem satisfactorily. They obtained high electrode current efficiences, for example 60.5%, at very low anode current densities, for example 10 mamp/cm$^2$ using a stationary anode. However, when they attempted to increase anode current density to 30 mamp/cm$^2$ the current efficiency dropped to less than 50%. Even the use of saturated cerous ion solutions, for example 0.15 to 0.17 molar cerous sulphate and anodes spinning at, for example, 3,000 rmp, did not provide high current efficiencies with high current densities. As an example a satisfactory performance might be considered 50% current efficiency or higher at current densities of 50 mamp/cm$^2$ or higher.

The above British Pat. No. 1,192,037 describes the regeneration of ceric oxidants in nitric acid electrolyte but no information is given on the regeneration of cerium oxidants in sulphuric acid electrolytes. No information is given concerning percentage conversion of cerous ion to ceric ion, initial cerous ion concentration, electrolyte volume, temperature, mixing conditions, acid type and concentration cathode current density and nature of the ion exchange membrane. Experiments carried out by the present inventor have not, without recourse to the present invention, been able to achieve the current densities and current efficiencies on platinum anodes described in the above British patent even with well stirred electrolytes.

SUMMARY OF THE INVENTION

Accordingly, the present invention seeks to provide an electrolytic process for converting cerous ion to ceric ion in an electrolytic cell including a cathode, an anode and an electrolyte and is the improvement that comprises incorporating cobalt into the electrolyte in addition to the cerous ion.

The cobalt ion may be introduced into the electrolyte eithr as the metal or as a cobaltous salt, for example cobaltous nitrate or cobaltous sulphate.

A further improvement has been displayed by incorporating silver into the electrolyte if cobaltous ion is present. Silver again may be added in the form of the metal or as a silver salt. An effective silver concentration in the electrolyte has proven to be any concentration up to $10^{-2}$ molar. Cerous ion can be any value. Electrolytes which are saturated or supersaturated in cerous ion are ideally suited to the present invention.

The oxidation of the cerous salt takes place, of course, at the anode. Suitable anodes include lead dioxide and platinum anodes. The lead dioxide may be coated on a carbon substrate or other substrate by electroplating or may be anodized lead dioxide.

Cobaltous ion mass transfer in the process of the present invention is excellent. This is believed to be because of the high solubility of the ion in cerous ion-containing electrolytes, even in unstirred electrolytes. This is especially so if some gassing occurs at the electrodes to increase turbulence. Cobaltous ion is readily oxidized at the anode to cobaltic ion. The cobaltic ion is not normally considered a stable ion but it is stable for a sufficient period to allow it to migrate back to the bulk of the electrolyte from the anode surface and react with dissolved cerous ion to form ceric ion.

The presence of the small amount of silver has a catalytic improving effect on the cerous ion oxidation if cobaltous ion is present.

Results achieved include complete conversion of all dissolved cerous ion to ceric ion at very high current efficiencies even at low concentration of cerous ion and even in unagitated electrolytes. Saturated or supersaturated ceric oxidants have been prepared from supersaturated cerous ion containing electrolytes.

It should be noted that the use of a silver catalysts alone does not offer significantly improved performance, that is it does not improve to any worthwhile extent the conversion of cerous ion to ceric ion.

The method of the present invention produces chemical oxidants that comprise a mixture of cobaltic and ceric ion or even ceric ion plus cobaltic ion plus argentic ion by converting all cerous ion to ceric ion. Further the method is accompained by very high current efficiencies and very high current densities. The use of the method according to the present invention is applicable to a wider variety of electrochemical cell designs as it is applicable to the problem of cerous ion mass transfer that is a feature of any cell design.

EXAMPLES

Table 1 set out below shows, comparatively, the effect of cobalt and silver catalysts on the efficiency of cerium oxidant production from a variety of cerous salts. The results were achieved by electrolysis in an undivided electrochemical cell, that is no diaphragm was used to separate the anolyte and the catholyte. A central rod anode comprising 700 microns of electroplated lead dioxide on a graphite substrate or a central disc anode comprising a circular platinum crucible lid half submerged in electrolyte were used. A pair of platinized tantalum wire cathodes were used. It has been found that a wide variety of other cathode materials are also suitable. Such materials are well within the knowledge of the skilled man. They include, for example, silver plated lead and tungsten.

Electrolyte stirring was not necessary but, if used, was carried out at constant speed with a magnetic stirrer bar. Electrolyte oxidant concentration was measured by potentiometrically titrating an aliquot of the electrolyte with standarized ferrous ammonium sulphate.

TABLE 1

EFFECT OF CATALYSTS ON CERIUM OXIDANT PRODUCTION EFFICIENCY

| Form of Cerous Ion | Initial Electrolyte Molarities $Ce^{3+}$ | $Ce^{4+}$ | $Co^{2+}$ as Cobaltous Sulphate | $Ag^{1+}$ as Silver Nitrate | Acid*** | Electrolyte Stirred** | Anode | Anode current density mamp/cm$^2$ | Electrolysis time (min.) | Current Efficiency % | % Cerous Ion Conversion to Ceric Ion |
|---|---|---|---|---|---|---|---|---|---|---|---|
| Cerous sulphate | 0.023 | 0.017 | 0 | 0 | 2.5 | no | electroplated $PbO_2$ on graphite | 100 | 5 | 8.0 | 18.2 |
| Cerous sulphate | 0.023 | 0.017 | 1.0 | 0 | 2.5 | no | ↓ | 100 | 5 | 15.0 | 34.2 |
| Cerous sulphate | 0.023 | 0.017 | 0 | 0.01 | 2.5 | no | ↓ | 100 | 5 | <1 | <1 |
| Cerous sulphate | 0.023 | 0.017 | 1.0 | 0.01 | 2.5 | no | ↓ | 100 | 5 | 62.7 | >100* |
| Cerous ammonium nitrate | 0.021 | 0.019 | 0 | 0 | 2.5 | no | ↓ | 100 | 5 | 2.0 | 5.1 |
| Cerous ammonium nitrate | 0.021 | 0.019 | 1.0 | 0 | 2.5 | no | ↓ | 100 | 5 | 1.6 | 3.9 |
| Cerous ammonium nitrate | 0.021 | 0.019 | 0 | 0.01 | 2.5 | no | ↓ | 100 | 5 | <1 | <1 |
| Cerous ammonium nitrate | 0.022 | 0.018 | 1.0 | 0.01 | 2.5 | no | ↓ | 100 | 5 | 67.0 | >100* |
| Cerous nitrate | 0.020 | 0 | 0 | 0 | 2.5 | no | ↓ | 100 | 5 | 2.4 | 6.2 |
| Cerous nitrate | 0.020 | 0 | 1.0 | 0 | 2.5 | no | ↓ | 100 | 5 | 9.9 | 24.8 |
| Cerous nitrate | 0.020 | 0 | 0 | 0.01 | 2.5 | no | ↓ | 100 | 5 | <1 | <1 |
| Cerous nitrate | 0.020 | 0 | 1.0 | 0.01 | 2.5 | no | ↓ | 100 | 5 | 56.0 | >100* |
| Cerous sulphate | 0.023 | 0.017 | 1.0 | 0.01 | 2.5 | no | ↓ | 100 | 3 | 71.3 | 91.5 |
| Cerous sulphate | 0.023 | 0.017 | 1.0 | 0.01 | 2.5 | yes | ↓ | 100 | 3 | >99 | >100* |
| Cerous sulphate | 0.023 | 0.017 | 0 | 0 | 2.5 | yes | ↓ | 200 | 1.5 | 1.5 | 2.1 |
| Cerous sulphate | 0.023 | 0.017 | 1.0 | 0 | 2.5 | yes | electroplated $PbO_2$ on graphite | 200 | 1.5 | 43.2 | 59.0 |
| Cerous sulphate | 0.023 | 0.017 | 0 | 0.01 | 2.5 | yes | ↓ | 200 | 1.5 | <1 | <1 |
| Cerous sulphate | 0.023 | 0.017 | 1.0 | 0.01 | 2.5 | yes | ↓ | 200 | 1.5 | 72.8 | >100* |
| Cerous ammonium nitrate | 0.022 | 0.018 | 1.0 | 0.01 | 2.5 | yes | ↓ | 200 | 1.5 | 60.7 | 87.0 |
| Cerous nitrate | 0.020 | 0 | 1.0 | 0.01 | 2.5 | yes | ↓ | 200 | 1.5 | 56.1 | 88.9 |
| Cerous sulphate | 0.023 | 0.017 | 0 | 0 | 2.5 | yes | platinum | 200 | 1.5 | 1.9 | 2.1 |
| Cerous sulphate | 0.023 | 0.017 | 1.0 | 0 | 2.5 | yes | platinum | 200 | 1.5 | 42.8 | 45.6 |
| Cerous sulphate | 0.023 | 0.017 | 0 | 0.01 | 2.5 | yes | platinum | 200 | 1.5 | 3.9 | 4.1 |
| Cerous sulphate | 0.023 | 0.017 | 1.0 | 0.01 | 2.5 | yes | platinum | 200 | 1.5 | 68.1 | 72.6 |
| Cerous nitrate | 0.02 | 0 | 1.0 as cobaltous nitrate | 0.01 | 5.0 as $HNO_3$ | yes | platinum | 200 | 1.5 | 60.7 | 90.0 |
| Cerous nitrate | 0.02 | 0 | 0 | 0 | 5.0 as $HNO_3$ | yes | platinum | 200 | 1.5 | 8.9 | 13.2 |

*>100% designates all cerous ion converted to ceric ion together with some residual cobaltic ion or argentic ion.
**All solutions where stirred under indentical conditions where designated "yes".
***Acid is sulphuric unless designated otherwise. All electrolyses were carried out at room temperature.

Table 2 shows compartively the effect of cobalt and silver catalysts on the efficiency of cerium oxidant productin from supersaturated cerous ion containing electrolytes so as to produce very concentrated (saturated or supersaturated) ceric ion containing electrolytes.

In order to prevent the silver and/or cobalt catalyst from being electrodeposited on the cathode and thereby reducing current efficiency during a prolonged electrolysis a modified electrolysis circuit was developed as illustrated in the FIGURE, which is a schematic view of an electrolysis circuit.

Two temporary electrodes (platinum wire) were used together with the electroplated lead dioxide on graphite electrode described previously. The electrodes are designated as follows:

p+—permanent anode (lead dioxide)

t+—temporary anode (platinum wire)

t−—temporary cathode (platinum wire)

By maintaining a constant positive voltage on p+ and switching the polarity of t+ to t− and t− to t+, every few seconds, the electrodeposition of the silver or cobalt catalysts was prevented, since the catalyst dissolved from t+ while it was being electro deposited onto t−.

The experiment documented in Table 2 indicate that it is possible to use saturated or supersaturated cerous ion containing electrolytes to produce saturated or supersaturated ceric ion containing electrolytes. The more concentrated the ceric solution is the more useful it is an oxidant.

It is preferable to redissolve the catalyst electrodeposit continuously as shown in the FIGURE rather than remove it manually, due to cost. The fact that a small amount of current is wasted in the redissolution of the catalyst(s) (i.e. current in t+ to t− circuit) does not drastically alter the net cell current efficiency.

TABLE 2

EFFECT OF CATALYST ON CERIUM OXIDANT PRODUCT FROM CONCENTRATED CEROUS ION CONTAINING ELECTROLYTES

| | | | | |
|---|---|---|---|---|
| Electrode current density mamp/cm$^2$ | | | | |
| p+ | 100 | 100 | 100 | 100 |
| t+ | 43 | 0 | 0 | 43 |
| t− | 495 | 452 | 452 | 495 |
| Electrode current amps | | | | |
| p+ to t− | 0.420 | 0.420 | 0.420 | 0.420 |
| t+ to t− | 0.040 | 0 | 0 | 0 |
| Initial Electrolyte Composition | | | | |
| volume ml | 100 | 100 | 100 | 100 |
| Molarity | | | | |
| $H_2SO_4$ | 5.0M | 5.0M | 5.0M | 5.0M |
| $CoSO_4 . 7H_2O$ | 0.7M | 0.7M | 0 | 0 |
| $AgNO_3$ | 0.004M | 0 | 0 | 0.004 |
| $Ce_2(SO_4)_3$ | 0.1M* | 0.1M* | 0.1M* | 0.1M* |
| Temperature during electrolysis | 19–22° C. | 20–23° C. | 20–24° C. | 20–23° C. |
| Final Electrolyte composition | | | | |
| Ceric sulphate (dissolved) | 0.48M | 0.129M | 0.014M | 0.0447M |
| Ceric sulphate (superficial) | 0.55M** | 0.129M | 0.014M | 0.0447M |
| Current efficiency for ceric ion production*** | 78.2% | 17.2% | 3.0% | 5.9% |
| % cerous ion to ceric ion conversion | 99% | 24% | 3% | 6% |

*electrolyte supersaturated i.e. 20g of BDH $Ce_2(SO_4)_3 . X H_2O$ containing 77% $Ce_2(SO_4)_3$ and 23% $H_2O$

**includes undissolved ceric sulphate assuming it dissolved (i.e. electrolysis produced a supersaturated cerium oxidant)

***current used in t+ to t− circuit used in current efficiency calculation

All electrolytes were stirred under identical conditions.

I claim:

1. In an electrolytic process for converting cerous ion to ceric ion in an electrolytic cell including a cathode, an anode and an electrolyte the improvement that comprises incorporating cobalt into the electrolyte in addition to the cerous ion.

2. A process as claimed in claim 1 in which the cobalt is added as cobaltous sulphate.

3. A process as claimed in claim 1 in which the cobalt is added as cobaltous nitrate.

4. A process as claimed in claim 1 further including the step of incorporating silver into the electrolyte.

5. A process as claimed in claim 4 in which the starting silver concentration in the electrolyte is in the range of $4\times10^{-3}$ to $10^{-2}$ molar.

6. A process as claimed in claim 1 in which the cerous ion concentration is sufficient to make the electrolyte at least saturated with respect to cerous ion.

7. A process as claimed in claim 6 in which the cerous ion concentration is sufficient to make the electrolyte supersaturated with respect to cerous ion.

8. A process as claimed in claim 1 in which the anode is selected from lead dioxide and platinum.

9. A process as claimed in claim 8 in which the lead dioxide is coated on a carbon substrate.

10. In a process for electrolytically converting the cerous ion to the ceric ion in an electrolytic cell including an anode, a cathode and an electrolyte, the electrolyte containing sufficient cerous ion to make it at least saturated with regard to cerous ion the improvement that comprises conducting the electrolysis in the presence of cobalt.

11. A process as claimed in claim 9 further including the step of incorporating 0.01 molar silver ion as silver nitrate.

* * * * *